United States Patent [19]

Cahill et al.

[11] Patent Number: 5,000,323

[45] Date of Patent: Mar. 19, 1991

[54] CIGARETTE SEGREGATING APPARATUS

[75] Inventors: Michael J. Cahill; John Dawson; Julian W. Gardner, all of Coventry, England

[73] Assignee: Molins PLC, Milton Keynes, England

[21] Appl. No.: 436,936

[22] Filed: Nov. 14, 1989

Related U.S. Application Data

[63] Continuation of Ser. No. 169,261, Mar. 17, 1988, abandoned.

[30] Foreign Application Priority Data

Mar. 17, 1987 [GB] United Kingdom ..... 8706319
Feb. 10, 1988 [GB] United Kingdom ..... 8802974

[51] Int. Cl.[5] ..... B07C 5/00

[52] U.S. Cl. ..... 209/536; 209/588; 209/644; 209/535; 209/250; 209/223 R

[58] Field of Search ..... 209/580–582, 209/586, 588

[56] References Cited

U.S. PATENT DOCUMENTS

| | | | |
|---|---|---|---|
| 3,410,402 | 5/1966 | Gundrum et al. | 209/922 |
| 3,812,349 | 5/1974 | Gugliotta et al. | 250/223 R |
| 3,944,819 | 3/1976 | Sherwood | 209/580 |
| 4,147,619 | 4/1979 | Wassmer et al. | 209/580 |
| 4,271,968 | 6/1981 | Mehrkam et al. | 209/581 |
| 4,301,928 | 11/1981 | Coccia | 209/657 |
| 4,496,055 | 1/1985 | Green et al. | 209/535 |
| 4,667,831 | 5/1987 | Mattei et al. | 209/535 |

FOREIGN PATENT DOCUMENTS

| | | |
|---|---|---|
| 100537 | 2/1984 | European Pat. Off. . |
| 24366 | 2/1987 | European Pat. Off. . |
| 249791 | 6/1987 | European Pat. Off. . |
| 2001839 | 2/1979 | United Kingdom . |
| 1576004 | 10/1980 | United Kingdom . |
| 2073576 | 10/1981 | United Kingdom . |
| 2133271 | 7/1984 | United Kingdom . |
| 2150807 | 7/1985 | United Kingdom . |
| 2167939 | 6/1986 | United Kingdom . |
| 2193314 | 2/1988 | United Kingdom . |

*Primary Examiner*—H. Grant Skaggs
*Assistant Examiner*—Steven M. Reiss
*Attorney, Agent, or Firm*—John C. Smith, Jr.

[57] ABSTRACT

Moving cigarettes are inspected, particularly in the passages (10, 30) between the vanes (12, 32) in a cigarette packing machine hopper, by an optical ends inspector (74, 76) which is switched by a position detector (84, 86) responding to passage of individual cigarettes. Faulty cigarettes are arrested by a suction aperture (26) or an arrestor are (122, 222) and subsequently rejected from the passage, either in an axial direction or sideways through an opening (116, 244) in the vane. The position detector (84, 86) may activate the suction or arm for arresting the faulty cigarette.

36 Claims, 6 Drawing Sheets

CIGARETTE SEGREGATING APPARATUS

Figure 1:
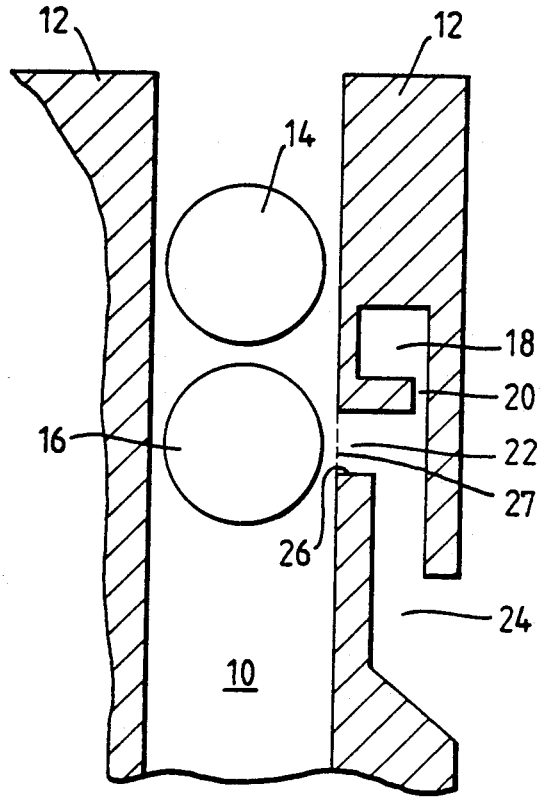

This application is a continuation of application Ser. No. 169,261, filed Mar. 17, 1988, now abandoned.

This invention relates to cigarette segregating apparatus, and particularly to apparatus for segregating faulty cigarettes in cigarette packing machines.

In cigarette packing machines cigarettes are allowed to pass down a plurality of passages (usually seven in number) from the bottom of which they are axially ejected into the required collations (usually groups of twenty).

In order to ensure that the full group or complement of cigarettes is satisfactory, it is known to inspect the cigarettes for end faults at a position upstream of the axial ejection position. However, if any faulty cigarette is detected, it is then conventional to reject the entire group of cigarettes.

This drawback has been recognised for a long time, and in recent years endeavours have been made to establish means for rejecting only those cigarettes which are faulty. Most of these proposals have involved rejecting the faulty cigarettes relatively close to the position at which they are axially rejected, i.e. in the lower portions of the passages. Examples of such proposals are the arrangements described in British patent specifications Nos. 2073576, 2133271 and 2156325. A disadvantage of rejecting cigarettes relatively close to the positions from which they are normally axially removed from the passages is that there is relatively little time for other cigarettes to fall to make up for gaps created by rejected cigarettes, particularly where relatively adjacent cigarettes are rejected.

There have been proposals which may overcome this potential problem. For example, in British patent specification No. 2001839 a packing machine hopper is provided with a separate set of passages in a unit within the reservoir section of the hopper and above the normal passages, the testing and rejection of cigarettes being performed in that unit. This results in a cumbersome and expensive hopper. Similarly, in British patent specification No. 2108818 there is a relatively complex arrangement in which each lower portion of a passage in a cigarette packing machine hopper is connected to two upper portions which feed cigarettes alternately to the lower portion, each upper portion having cigarette testing and rejection means.

An object of the present invention is to provide a cigarette segregating apparatus capable of use in a cigarette packing machine and overcoming at least some of the disadvantages found in previously proposed arrangements. To this end it is proposed that the apparatus of the invention be particularly well suited for use at or in the upper or intermediate portions of passages leading downwards in a cigarette packing machine hopper. This has the advantage that cigarettes rejected in such upper portions leave gaps which are more readily filled since they are inherently further from the position at which cigarettes are normally axially ejected from the passage to form the group of cigarettes, and hence more time is allowed for filling of the gaps by following cigarettes. Furthermore, since there will be fewer cigarettes resting on a cigarette to be rejected at an upper portion of the passage as compared with a lower portion of the passage, the friction or resistance to axial rejection of a cigarette to be rejected in the upper portion is inherently less so that the axial rejection hence becomes more reliable. Moreover, since in a cigarette packing machine hopper the passages generally converge so that the vanes separating the passages are thicker at their upper portions than at their lower portions, mounting of and access to segregating apparatus associated with the upper portions of the passages is easier and/or less complex than with such apparatus associated with the lower portions.

According to one aspect of the invention apparatus for segregating faulty cigarettes, particularly in the hopper of a cigarette packing machine, comprises a passage along which cigarettes may pass in a single row in a direction substantially transverse to their lengths, means for testing individual cigarettes during their movement through the passage to identify faulty cigarettes, means for ejecting faulty cigarettes from the passage, and control means responsive to position of cigarettes in the passage for activating at least one of the testing means and the ejecting means. Preferably the control means includes first means responsive to position of cigarettes for indicating when a cigarette is correctly positioned relative to the testing means, and second means responsive to position of cigarettes for indicating when a faulty cigarette is correctly positioned relative to the ejecting means. Preferably said first and second means of said control means include a common position detector for cigarettes in said passage.

The apparatus of the invention is capable of operation in association with a passage where the positions of cigarettes are not predictable or well-defined. By way of explanation, it should be understood that the lower portions of passages in or associated with hoppers in cigarette packing machines are normally each filled with a single row or column of cigarettes which move downwards through the passages in well-defined stepped motion as cigarettes are axially ejected from the lower end of such passages to form the groups for eventual packing. Above the lower portions of the passages, however, the cigarettes may still be abutting or there may be gaps between them as they fall from the hopper reservoir above and the occupation of such portions of the passages can change unpredictably. Even where there is an abutting column of cigarettes extending up to an upper portion of a passage, the positions of cigarettes at any instant is not well-defined since the build-up of tolerances and/or slightly differing positions of lower cigarettes and/or bounce of cigarettes as the column of cigarettes falls in stepped motion becomes much more significant above the lower portions of the passages. Hence, the provision of means responsive to position of cigarettes in the passage renders the apparatus particularly well suited for use in the upper portions of such passages. In accordance with a further feature of the invention particularly adapting it for use in this location, the ejecting means includes means for arresting a moving faulty cigarette in the passage.

According to another aspect of the present invention there is provided apparatus for segregating faulty cigarettes, particularly in a cigarette packing machine, comprising a passage along which cigarettes are arranged to pass laterally in a direction substantially perpendicular to their lengths in a single row, means for sensing faulty cigarettes to be segregated, means for arresting a moving faulty cigarette in the passage, and means for ejecting said faulty cigarette from the passage after it has been arrested. The arresting means may comprise suction means. The suction means may comprise means for generating suction by exhausting high pressure air.

Thus the suction means may comprise a suction aperture in a side wall of the passage, the side wall containing a chamber to which a pulse of high pressure air may be admitted and subsequently exhausted to apply suction to said aperture. Switching of high pressure air may be achieved more rapidly than direct connection to a vacuum source.

The testing or sensing means may be arranged to detect faults in a moving stream of cigarettes passing through the passage. The testing or sensing means may detect whether the tobacco end of a cigarette is sufficiently well filled and may, for example, comprise an arrangement substantially similar to that disclosed in British patent specification No. 1576004 or 2193314A. The testing or sensing means may include means for compensating for differences in illumination caused by differing axial positions of the ends of monitored cigarettes in such an arrangement.

The testing or sensing means may cooperate with a position detector having means for indicating that a cigarette is in a position for monitoring and also means for indicating passage of individual cigarettes. Such a detector may comprise means for directing a beam of radiation diagonally through at least part of the valley formed between abutting parallel cigarettes.

The or a similar position detector may cooperate with the arresting means so that this responds to a fault signal generated by the testing or sensing means to arrest and subsequently eject the faulty cigarette. Conveniently the testing or sensing means and arresting means may be arranged to be separated by a distance corresponding to a single cigarette diameter so that a common position detector located intermediate said positions can be used for both testing or sensing and arresting.

According to a further aspect of the present invention there is provided apparatus for segregating faulty cigarettes, particularly in a cigarette packing machine, comprising a passage along which cigarettes are arranged to pass laterally in a direction substantially perpendicular to their axes in a single row, means for sensing faulty cigarettes to be segregated, an opening at one side of the passage downstream of said sensing means, and means opposite said opening and activated by said sensing means for urging a faulty cigarette sideways in a direction perpendicular to its axis into said opening.

Said opening may normally be closed by a flap; and the urging means preferably comprises a mechanical pusher to urge a cigarette against and past said flap. Once the faulty cigarette has been rejected sideways past the flap it may be removed e.g. by being blown axially along a rejection tube out of the opening.

Alternatively said opening may be in the form of a cigarette retaining trap which is normally filled by a previously rejected cigarette, means being provided for axially ejecting said previously rejected cigarette prior to actuation of said urging means to urge the next faulty cigarette into the trap.

In place of, or additional to, said mechanical pusher there may be provided an air-stream means (e.g. an air jet) for urging a faulty cigarette sideways.

The passage may be between vanes in a cigarette packing hopper, and there may be a plurality of such passages disposed in a fan-shaped upright arrangement, so that the cigarettes descend by gravity in the conventional manner.

Location means may then be provided underneath each cigarette to be rejected, and preferably this takes the form of a mechanical support, e.g. a pivotally movable arrestor member which is extensible into the passage beneath the opening.

It will be appreciated that in apparatus in accordance with each aspect of the invention it is possible to reject two or more successive faulty cigarettes from each passage; the only limitation is believed to be the subsequent possible problem of starvation of a row of cigarettes in a passage resulting from excessive multiple rejections.

In a specific embodiment of a cigarette hopper a cigarette segregating device may be arranged in association with each passage of the hopper, and preferably such devices may be slightly staggered in a vertical direction, in order to accommodate the devices one next to the other.

Although the apparatus of the invention is particularly suited for use in or associated with a cigarette packing machine hopper, and in at least some aspects thereof particularly with the upper portions of passages leading downwards in or from such a hopper, the invention is not limited to use of apparatus in such location. More particularly, the use of apparatus in accordance with any of the aspects of the invention in or associated with the lower portions of passages in a cigarette packing machine hopper is not excluded. More generally, segregating apparatus according to the present invention may be used with rod-like articles other than cigarettes, e.g. filter rods. Accordingly, it should be understood that the term "cigarette" is used herein for convenience and reference herein to "cigarettes" should be construed as a reference to "cigarettes and similar rod-like articles".

Figure 2:
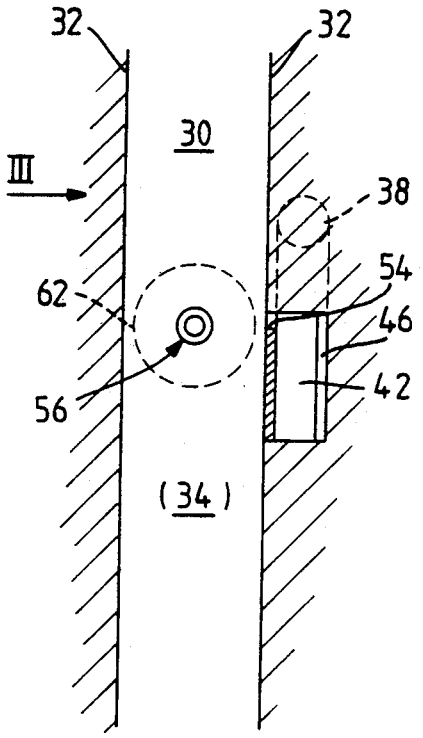
Figure 3:
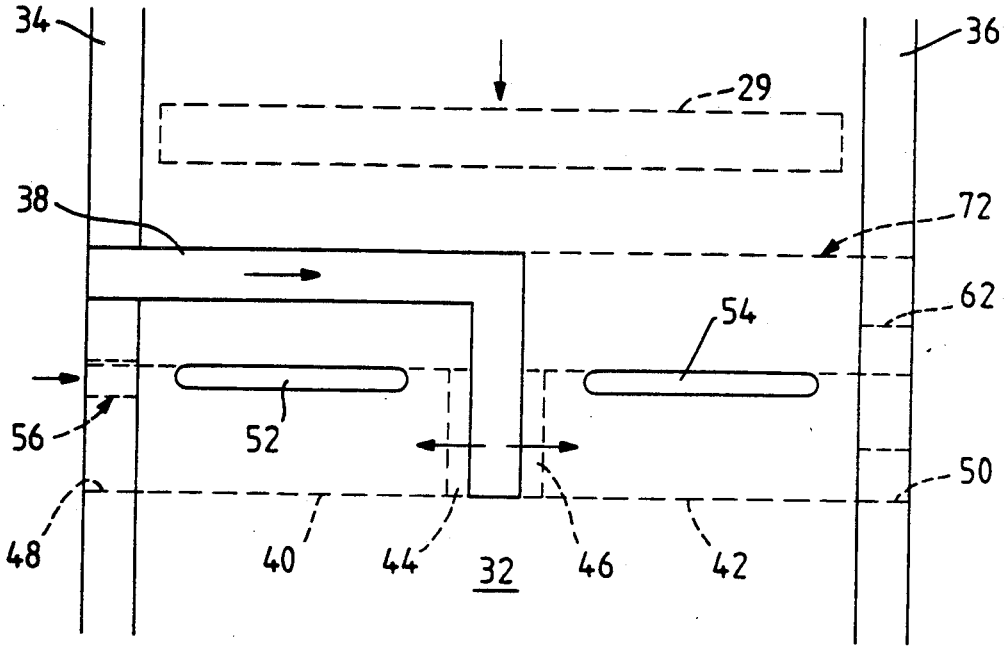
Figure 4:
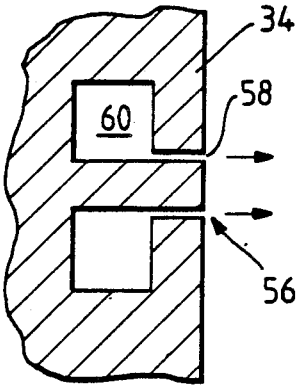
Figure 5:
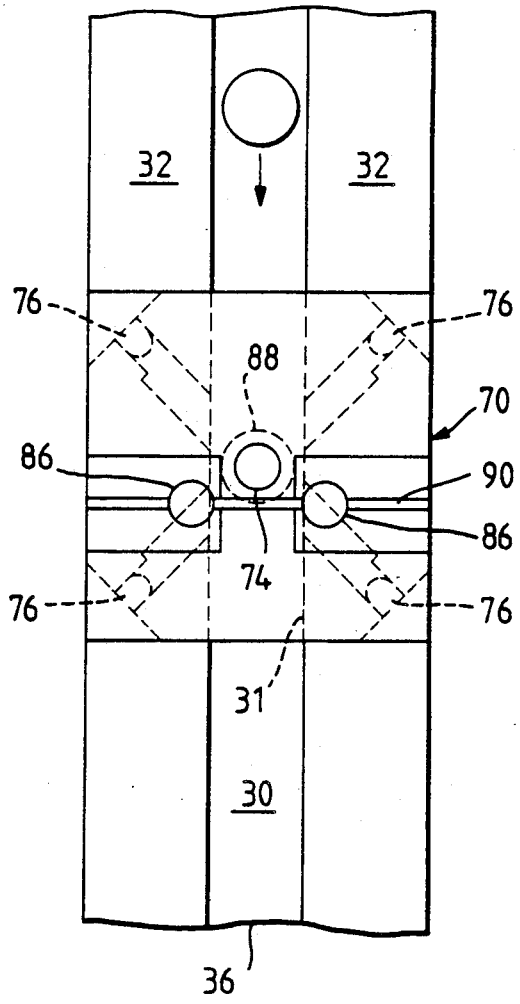
Figure 8:
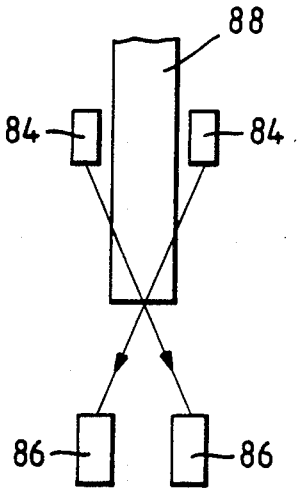
Figure 6:
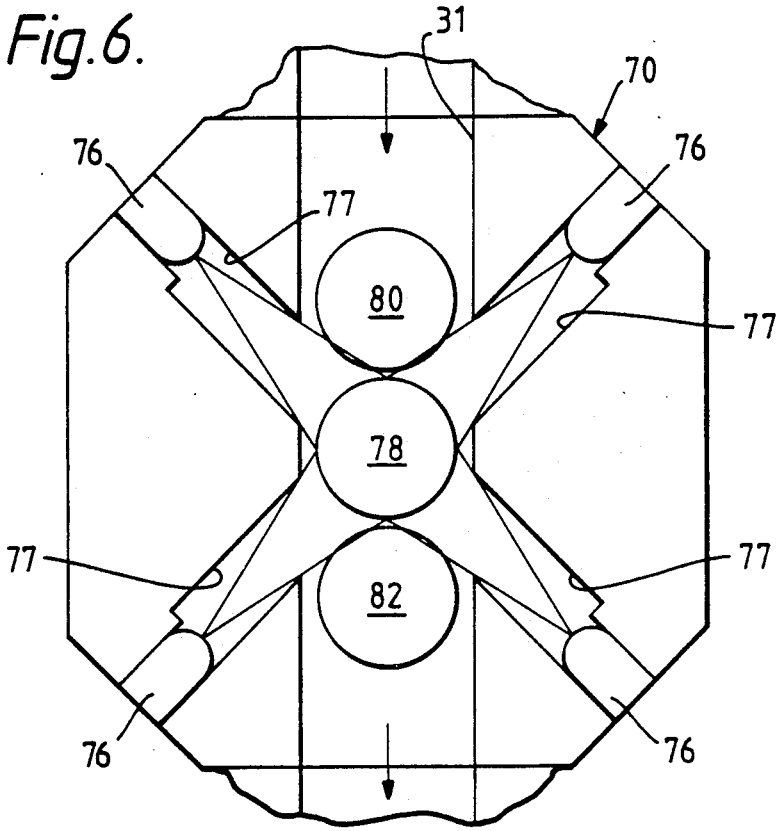
Figure 7:
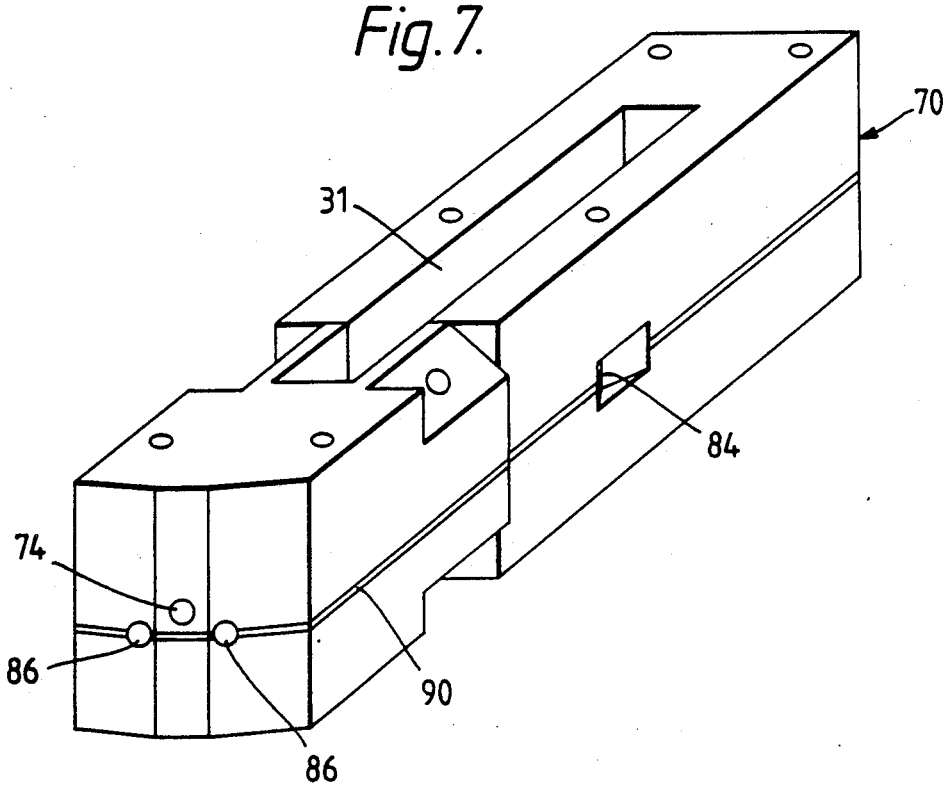
Figure 9:
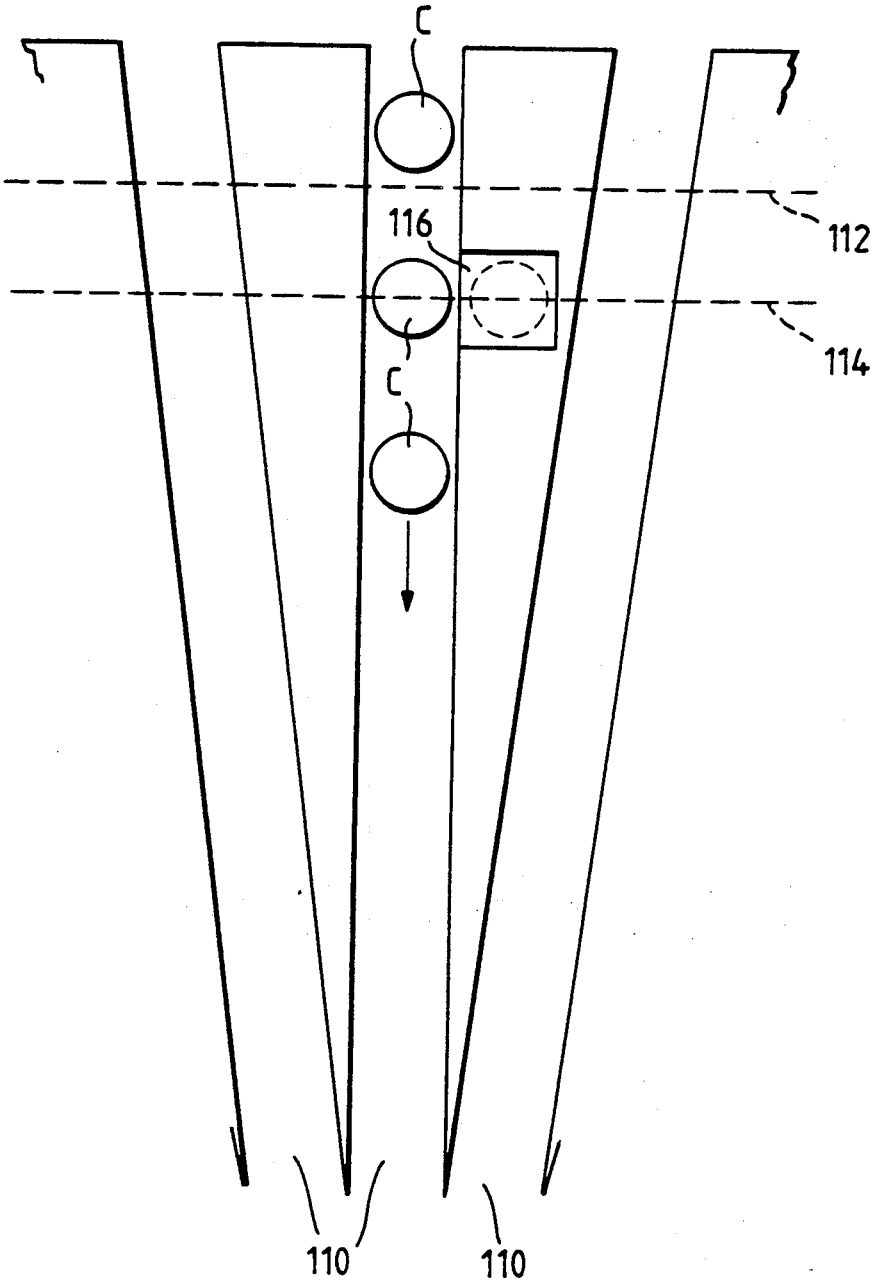
Figure 10:
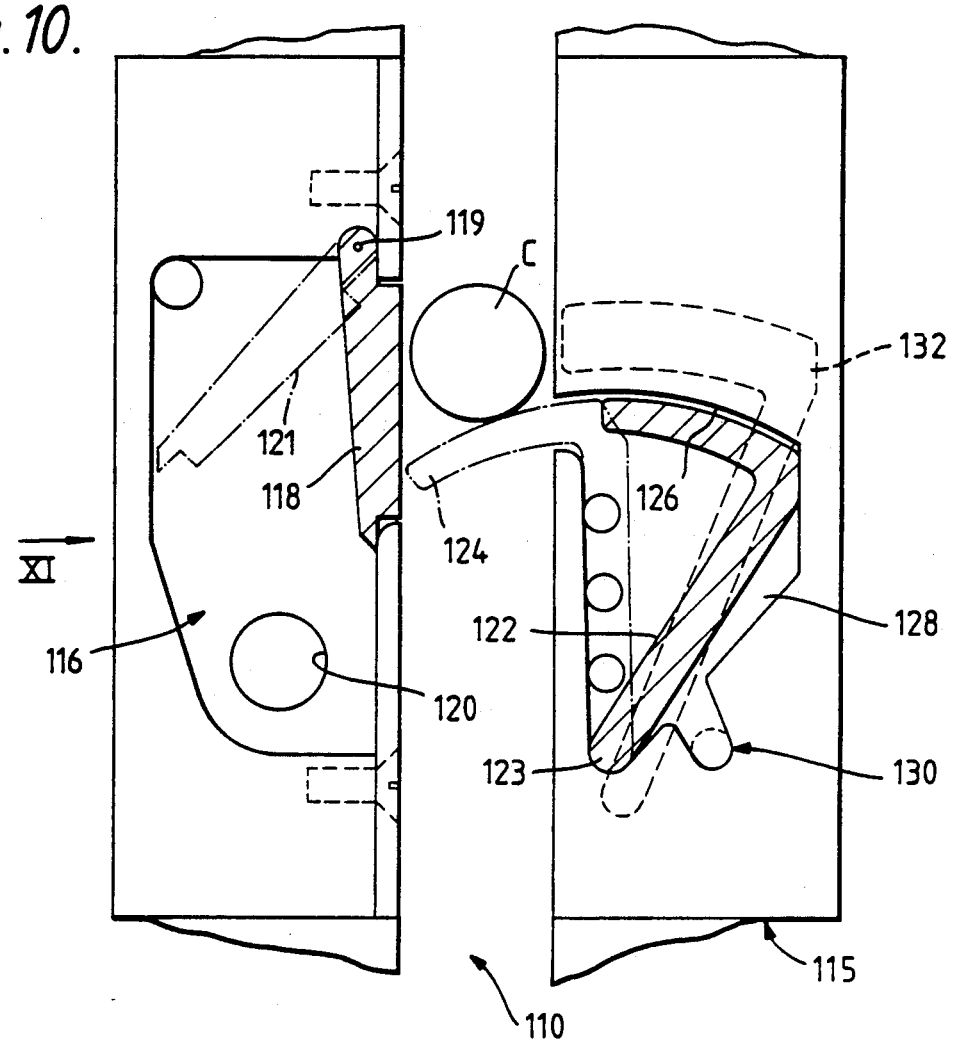
Figure 11:
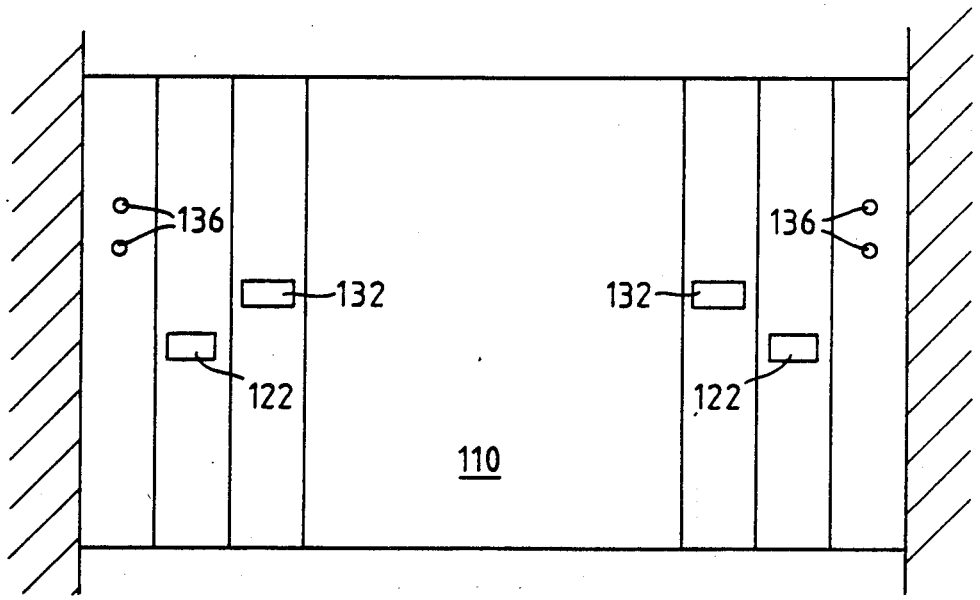
Figure 12:
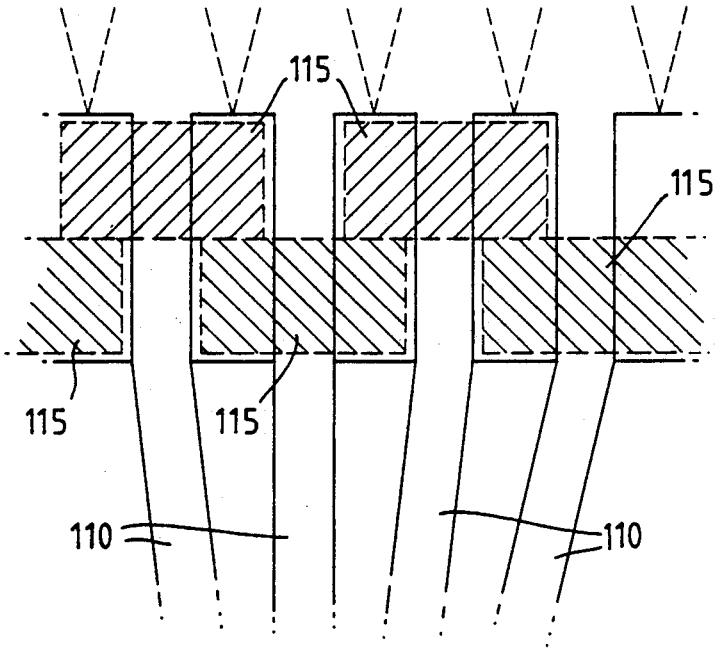
Figure 13:
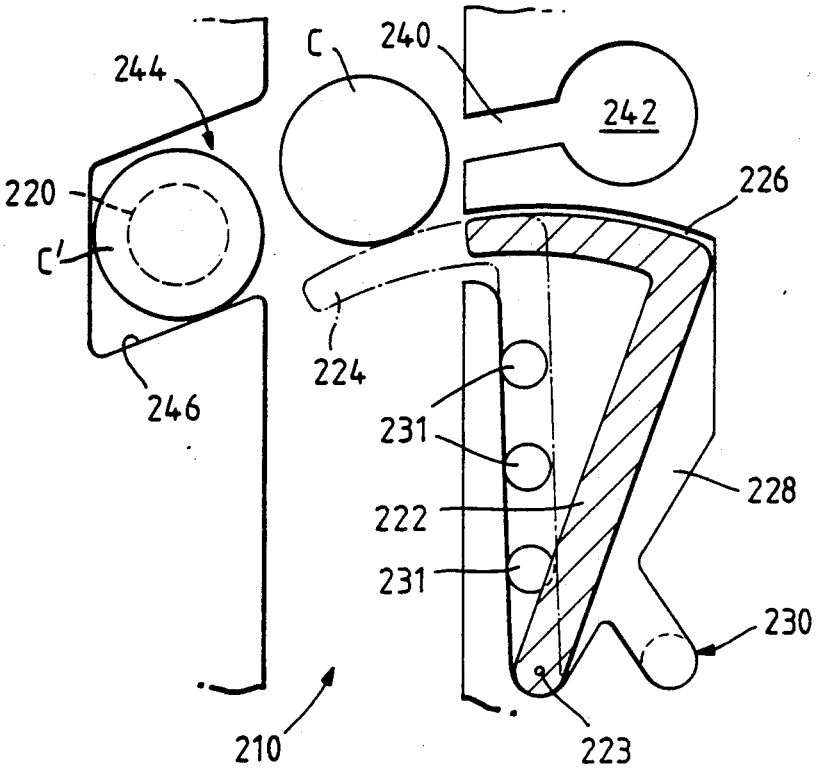

The invention will be further described, by way of example only, with reference to the accompanying diagrammatic drawings, in which:

FIG. 1 is a transverse sectional view of part of a hopper in a cigarette packing machine, FIG. 2 is a similar view of part of a modified hopper, FIG. 3 is a view in direction III in FIG. 2, FIG. 4 is 4 detail view of part of the hopper of FIG. 2, FIG. 5 is a schematic front view of part of a cigarette packing machine hopper including a detector head, FIG. 6 is a view at an enlarged scale of part of the detector head of FIG. 5, FIG. 7 is a perspective view of the detector head of FIG. 5, FIG. 8 is a view indicating how part of the detector head of FIG. 5 operates, FIG. 9 is a schematic front view of part of a further hopper, FIG. 10 is an enlarged rear view of part of the hopper of FIG. 9, FIG. 11 is an end view as seen in the direction of arrow XI in FIG. 10, FIG. 12 is a schematic front view of part of the hopper of FIG. 9 showing the arrangement of adjacent rejection units, and FIG. 13 is a view similar to that of FIG. 9 of part of a still further hopper.

FIG. 1 shows a passage 10 for descending cigarettes in a cigarette packing machine hopper. The passage 10 is formed between side walls or vanes 12. Cigarettes descending in the passage 10 are monitored by a detector head (not shown in FIG. 1) as they pass the position of cigarette 14. Following detection of a faulty cigarette at 14 a pulse of high pressure air is applied to a chamber 18 which runs substantially the full width of one of the vanes 12. Air under pressure in the chamber 18 discharges through a slit 20 into a further chamber 22 and thence to exhaust via passage 24.

The air exhausting through the slit 20 creates a low pressure zone in the chamber 22. The chamber 22 communicates with the passage 10 by way of a slot 26 and air drawn through the slot because of the low pressure in the chamber causes a cigarette at or approaching the position of cigarette 16 to be drawn and held against the slot. The slot 26 may have one or more bridging pieces 27 to reduce the risk of the cigarette jamming in the slot. The slot 26 and/or bridging pieces 27 may be shaped so as to form a seat against which a cigarette may be temporarily drawn. The timing of the response to detection of a faulty cigarette at position 14 is such that the faulty cigarette may be arrested at (or, more correctly, adjacent) position 16, substantially one cigarette diameter below the detection position.

A faulty cigarette arrested at position 16 is ejected axially by a blast of high pressure air.

FIGS. 2–4 show in more detail an arrangement which operates on the same principles as that of FIG. 1.

A passage 30 between vanes 32 conveys cigarettes 29 downwards in a cigarette packing machine hopper and includes end walls 34, 36. One of the vanes 32 includes a passage 38 connectable to a source of high pressure air. Twin chambers 40, 42 in the vane 32 communicate with the passage 38 through narrow slots 44, 46. The chambers 40, 42 are connected to atmosphere through exhaust apertures 48, 50 in the end walls 34, 36. The chambers 40, 42 have aligned slots 52, 54 connecting the chambers to the passage 30.

The end wall 34 contains an ejection jet 56 in line with the slots 52, 54. The jet 56 has an annular orifice 58 connected to an annular chamber 60 in the end wall 34. By providing an annular orifice 58 of diameter less than that of a cigarette disturbance of cigarettes adjacent the cigarette to be ejected is reduced on operation of the ejection jet 56.

An ejection aperture 62 is provided in the opposite end wall 36 in line with the ejection jet 56.

FIGS. 5–7 illustrate a detector head 70 which monitors the tobacco ends of cigarettes passing down the passage 30. The head 70 is located so that it can monitor a cigarette about one cigarette diameter above the position at which a faulty cigarette is ejected (i.e. cigarettes are monitored approximately along the line 72 in FIG. 3). The head 70 monitors the cigarettes for well-filled ends by shining light (preferably infra-red radiation) substantially axially at the ends of the cigarettes and then detecting from the sides the consequent amount of illumination of the paper wrapper surrounding the ends. In a well-filled cigarette this is less than in a cigarette where the absence of tobacco allows greater illumination of the paper wrapper. The detector head 70 uses a principle substantially similar to that disclosed in British patent specification No. 2193314A. Reference is directed to that specification for details, including those of a suitable control circuit, and its disclosure is hereby incorporated herein in its entirety.

Referring again to FIGS. 5–7, the detector head 70 has a passage 31 and the head is adapted to be mounted with this passage aligned with the passage 30 between vanes 32 so that cigarettes can pass through the passage 31. The head 70 includes a source 74 of infra-red radiation mounted in the end of the head adjacent the end wall 36 and arranged to shine radiation substantially parallel to the descending cigarettes. Four suitable detectors 76 monitor the consequent illumination of the side wrappers of the end portions of the cigarettes.

As shown particularly in FIG. 6, the detectors 76 have acceptance angles so that substantially the entire circumference of a cigarette 78 aligned with the source 74 is monitored. In addition the detectors 76 are recessed in slots 77 which additionally shield the detectors from radiation which may be scattered by neighbouring cigarettes 80, 82.

The axial positions of cigarettes in the passages 30, 31 is not precisely controlled, there being some clearance between the ends of the cigarettes and the end walls 34, 36. As compared with the arrangement of said British patent specification No. 2193314A, where the location of monitored cigarettes is controlled precisely, the shielding by recessing the detectors 76 in slots 77 and selecting detectors with appropriate acceptance angles facilitates use of the method of said specification in the present arrangement where location of cigarettes is less precisely controlled.

A cigarette passing the monitoring position in a recessed position, i.e. with its tobacco end further away from the source 74, will receive less illumination from the source and will also present less of its length for monitoring by the detectors 76. Thus the illumination detected from such a cigarette might be expected to be less than that from a cigarette not so recessed, which might result in a recessed faulty cigarette not being rejected. This effect may be compensated for by selecting and/or arranging the detectors 76 so that they have or are directed so that they have greater sensitivity at positions spaced inwardly from the end of a cigarette located in a mean or normal axial position. Thus, in the case of a cigarette in a position more recessed than this (i.e. further away from the source) the generally lower illumination level is compensated by the fact that the end of the cigarette (the surrounding paper wrapper of which receives more light than other parts of the paper wrapper spaced further from the end) is located at a position of greater sensitivity of the detectors 76. In this way the monitoring arrangement can be made to give sufficiently accurate (i.e. consistent) results over a sufficient range (a few millimetres) of possible axial positions of the ends of cigarettes.

Since cigarettes are moving downwards through the passage 31 such that the position occupied by a cigarette at any instant is unpredictable, and it is required to monitor cigarettes individually when they are aligned with the source 74, a position detector is provided to allow switching of the source 74 and/or control circuit connected to detectors 76. The position detector comprises a pair of infra-red or other radiation emitters 84 (only one of which is shown in FIG. 7) and a pair of detectors 86. The emitters 84 each direct a beam of radiation diagonally across the path of the cigarettes so that the detectors 86 receive radiation only when the intersection between abutting or adjacent cigarettes is passing the beams, the latter being obscured by the ends of the cigarettes at other times. The detectors 86 will therefore receive pulses of light corresponding to the gaps between cigarettes. The trailing edge of a pulse of light will correspond to a cigarette reaching the position indicated at 88 in FIG. 5. The principle of operation of the emitters 84 and detectors 86 is shown in FIG. 8.

The positions of the emitters 84 and detectors 86 could be interchanged. In that case a single emitter or source could be used positioned closely adjacent to the intersection of the beams shown in FIG. 8.

As shown in FIGS. 5 and 7, a sheet of Perspex (RTM) 90 or other similar material is sandwiched in the detector head 70 and aligned with the emitters 84 and detectors 86. This assists in directing the beams in the required directions by internal reflection so that loss of intensity is significantly reduced.

It is expected that normally cigarettes passing the detectors 76 will be abutting or nearly abutting but since the control circuit for detectors 76 responds to an edge of a pulse of light received by the detectors it is capable of responding correctly when the size of the gaps between cigarettes is unpredictable.

The position detector comprising emitters 84 and detectors 86 is also used to control the pulse of air admitted to the passage 38 to cause arresting and subsequent ejection of a faulty cigarette detected by the detectors 76. Thus, where the ejection position is located substantially one diameter or cigarette position below the detection position 72 the pulse of air is admitted to the passage 38 on detection by the detectors 86 that the cigarette previously aligned with the source 74 has passed below the line of the detectors 86. In other words, in this instance the detectors 86 receive pulses of light corresponding to the movement of successive cigarettes and if a fault signal is generated by a cigarette following one pulse then an arrest and ejection signal is generated at or following the next pulse, the latter indicating that the faulty cigarette has moved the single cigarette position between the detection and ejection positions. In principle, it is possible for the detection and ejection positions to be spaced apart by more than one diameter but this may create difficulties in ensuring that the correct cigarettes are ejected if a single position detector is used. It would, of course, be possible to provide separate position detectors associated respectively with the monitoring and ejection of cigarettes, together with a circuit including a count memory to ensure that correct cigarettes are ejected. The position detector could be above the detection position (in which case the leading edge of a light pulse may indicate correct cigarette position).

Where a cigarette packing machine hopper includes a plurality of vanes and corresponding passages, each passage may be provided with a detector head and associated arresting and ejection means. Preferably these are located relatively high up in the passages so that in the event of ejection of several successive cigarettes in any particular passage this does not result in the so-called "vane starvation", i.e. there is sufficient time before transfer at the bottom of the passages for following cigarettes to fall freely through the passage to make up for gaps created by ejection.

Referring now to FIG. 9, there are shown three passages 110 in a cigarette hopper. Cigarettes C are shown descending from the top of the vertical middle passage 110.

At the level indicated at 112 an inspection device detects the ends of the cigarettes, and this detection may be performed in any known manner, and the device may for example comprise a device similar to the detector head 70 of FIGS. 5–8. At level 114 is a rejection unit 115 providing for any faulty cigarette to be rejected sideways to the right into a rejection opening, shown at 116. A satisfactory cigarette, however, continues to descend to the bottom of the passage 110 where it will be axially ejected along with other satisfactory cigarettes to form a group or bundle of cigarettes.

Referring to FIG. 10, the rejection opening 116 (now shown to the left of the passage 110) is bounded by a flap 118 which is pivoted at its upper end 119. The flap 118 is movable inwardly to a position 121 shown chain-dotted. Towards the bottom of the opening 116 there is positioned an ejector jet 120 where a faulty cigarette rejected into the opening can be axially ejected out through a rejection tube (not shown).

To the right of the opening 116, as viewed in FIG. 10, there is shown an arrestor device comprising an inverted L-shaped arrestor arm 122 pivoted at the bottom 123 and movable into the passage 110, as shown at the chain-dotted position at 124. The upper part 126 of the enclosure for the arrestor arm 122 is radiussed so as to provide a close fit with the arm. Thus a chamber 128 is formed behind the arm into which air can be supplied through a duct 130, thereby activating the arrestor arm 122 to move outwardly into the chain-dotted position 124.

Behind the arrestor arm 122 is shown a similar, though taller, inverted L-shaped pusher member 132 which is likewise pivoted at its lower end. The pusher member 132 is operated by compressed air in a similar manner to that of the arrestor arm 122.

As shown in FIG. 11 the arrestor arms 122 and pusher members 132 do not extend horizontally across the full depth of the passages 110, emerging into the passages only as elongated rectangular pins at each side of the vertical centre line of the passages. A pair of pusher members 132 for a passage 110 may be linked together, whereas the arrestor arms 122 may need to be separately operated at each end. Similarly the flap 118 need not extend the full depth of the passages, but could be a pair of short flaps spaced apart.

At each side of the centre line of the passage 110 there may also be positioned sensing devices 136, which may be operated in conjunction with ends detection or inspection devices (not shown). For example, the devices 136 may correspond with the detectors 76 in the detector head 70 of FIGS. 5–8.

FIG. 12 shows how rejection units 115 may be associated with each passage 110 in a hopper by being staggered alternately above and below one another along the top of the passages.

In operation of the apparatus of FIGS. 9–12, cigarettes pass down through the top of the passage 110 past the position sensors 136, where they are inspected for satisfactory ends. If a faulty cigarette is detected the arrestor arms 122 are activated to move them out into the extended position 124, and shortly afterwards the pusher members 132 are similarly activated to reject the cigarette sideways against the flap 118 and into the rejection opening 116. From here the cigarette is axially removed by the air jet 20 ejecting it out through the rejection tube (not shown).

Referring finally to FIG. 13, there is shown a modification of the device of FIG. 10, in which similar parts are indicated by the previous reference numeral increased by 100.

An arrestor arm 222, having an arcuate width (as viewed in FIG. 13) rather smaller than that of the arrestor arm 122, is shown in full lines in its retracted position, and at 224 is shown chain-dotted in its extended position. Actuation of the arrestor arm 222 is again by air pressure applied to a chamber 228 to the right of the arrestor arm through a duct 230. Air in the space in front of (i.e. to the left of) the arrestor arm 222 is evacuated through ducts 231.

Above the arrestor arm 222 is an elongated slit 240 extending axially along the side of a cigarette C which, in the position shown, would be held up by the arrestor arm if in the operative position 224. Air under pressure is supplied to the slit 240 which could instead be a plurality of discrete apertures) from a duct 242.

To the left, as viewed in FIG. 13, i.e. opposite the slit 240, is a cigarette trap 244 shaped to hold a cigarette C' which was previously rejected. The lower surface 246 of the trap 244 is downwardly inclined into the wall of the passage 210 so as to retain the cigarette C', and the width of the trap is substantially equal to the diameter of a cigarette, so that the right-hand side of the cigarette C' is tangential to the left-hand wall of the passage 210. Positioned axially behind the cigarette C' is an ejector jet 220 similar to the jet 120 of FIG. 10.

In operation, when a faulty cigarette C is detected the arrestor arm 222 is projected into the position 224 by air pressure in the chamber 228, thus supporting the cigarette C. At about the same time, or preferably fractionally sooner, the previous faulty cigarette C' is ejected from the trap 244 through a rejection tube (not shown). Thereafter the cigarette C is blown sideways into the trap by the air jet from the slit 240, so taking the place of cigarette C'. The presence of the previous faulty cigarette C' in the trap 244 substantially up until the next faulty cigarette is transferred to the trap prevents inadvertent occupation of the trap by non-faulty cigarettes and allows elimination of the flap 118.

The arrestor arm 222 is then retracted, this action being effected either by a return spring (not shown) or by suction being applied to the chamber 228 from the duct 230.

An advantage of the modified arrangement of FIG. 13, as compared with that of FIG. 10, is that the spacing between adjacent passages 210 can be reduced since the width of the trap 244 is reduced by the width of the eliminated flap 118. It is also believed that the cigarette can be moved sideways into the trap more quickly as the inertia of opening of the flap is eliminated.

In place of (or as well as) the air jet slit 240, it may be arranged to apply suction at the trap 244 to induce a cigarette to be rejected into the trap.

Furthermore in both the embodiments of FIG. 10 and FIG. 13 the air jet from slit 240 may either replace or supplement a mechanical pusher member such as member 132.

It will be appreciated that the arrangements described allow a cigarette hopper of relatively conventional design to be adapted by comparatively simple alterations to reject single cigarettes; and furthermore, if desired, there is no need for a separate ends detection device towards the bottom of the hopper, as is conventionally used.

The apparatus of FIGS. 9–12 and FIG. 13 may incorporate cigarette position detecting means constructed and operable in a substantially similar way to that of the means 84, 86 of FIGS. 5–8. In particular such detecting means could be used to initiate sensing by the devices 136 and/or operation of arrestor arms 122 or 222.

We claim:

1. Apparatus for segregating faulty cigarettes, particularly in the hopper of a cigarette packing machine, as said cigarettes pass in a single row in a direction substantially transverse to their lengths through a passage defined by wall means, the positions of said cigarettes as they pass through said passage being unpredictable and not in a well defined stepping motion, said apparatus comprising means for testing individual cigarettes at a predetermined first position along said passage during their movement through the passage to identify faulty cigarettes, means for ejecting faulty cigarettes from the passage at a predetermined second position along said passage downstream from said first position, means for detecting the presence of cigarettes at a predetermined detecting position in said passage as said cigarettes pass therethrough, said predetermined detecting position of said detecting means being different from said predetermined first position of said testing means and said predetermined second position of said ejecting means, and control means responsive to the detection of cigarettes by said detecting means for activating at least one of the testing means and the ejecting means.

2. Apparatus as claimed in claim 1, wherein said testing means and ejecting means are arranged to operate at substantially adjacent cigarette positions in said passage.

3. Apparatus as claimed in claim 1, wherein said control means comprises optical position detector means including sheet-like translucent means for directing radiation along a preferred path.

4. Apparatus for segregating faulty cigarettes, particularly in the hopper of a cigarette packing machine, as said cigarettes pass in a single row in a direction substantially transverse to their lengths through a passage defined by wall means, the positions of said cigarettes as they pass through said passage being unpredictable and not in a well defined stepping motion, said apparatus comprising means for testing individual cigarettes at a predetermined first position along said passage during their movement through the passage to identify faulty cigarettes, means for ejecting faulty cigarettes from the passage at a predetermined second position along said passage downstream from said first position, means for detecting the presence of cigarettes at a predetermined detecting position in said passage as said cigarettes pass therethrough, and control means responsive to the detection of cigarettes by said detecting means for activating at least one of the testing means and the ejecting means, said control means including first means responsive to the detection of said cigarettes by said detecting means as said cigarettes pass through said detecting position for indicating when a cigarette is correctly positioned for testing by the testing means, and second means responsive to the detection of said cigarettes by said detecting means as said cigarettes pass through said detecting position for indicating when a faulty cigarette is correctly positioned for ejection by the ejecting means.

5. Apparatus as claimed in claim 4, wherein said first and second means of said control means include a common position detector for cigarettes in said passage.

6. Apparatus for segregating faulty cigarettes, particularly in the hopper of a cigarette packing machine, as said cigarettes pass in a single row in a direction substantially transverse to their lengths through a passage defined by wall means, the positions of said cigarettes as they pass through said passage being unpredictable and not in a well defined stepping motion, said apparatus comprising means for testing individual cigarettes at a predetermined first position along said passage during their movement through the passage to identify faulty cigarettes, means for ejecting faulty cigarettes from the passage at a predetermined second position along said passage downstream from said first position, means for detecting the presence of cigarettes at a predetermined detecting position in said passage as said cigarettes pass therethrough, and control means responsive to the detection of cigarettes by said detecting means for activating at least one of the testing means and the ejecting means, said control means comprising an optical position detector including means for sensing a beam of radiation and means for directing a beam of radiation along a path inclined to the longitudinal axes of said cigarettes towards said sensing means such that it is interrupted by each successive cigarette passing through said passage and may pass through at least part of the valley formed between substantially abutting cigarettes in said passage.

7. Apparatus for segregating faulty cigarettes, particularly in the hopper of a cigarette packing machine as said cigarettes pass in a single row in a direction substantially transverse to their lengths through each of a plurality of substantially parallel passages defined by wall means and having adjacent inlet ends, the positions of said cigarettes as they pass through each of said passages being unpredictable and not in a well defined stepping motion, said apparatus comprising means associated with each of said passages for testing individual cigarettes at a predetermined first position along each of said passages during their movement through each of said passages to identify faulty cigarettes, means associated with each of said passages for ejecting faulty cigarettes from each of said passages at a predetermined second position along each of said passages downstream of said first position, means for detecting the presence of cigarettes at a predetermined detecting position in each of said passages as said cigarettes pass therethrough, and control means responsive to the detection of cigarettes by said detecting means for activating at least one of the testing means and the ejecting means, the respective distances of the testing means and ejecting means from the inlet end of each passage being different from the respective distances of the testing means and ejecting means from the inlet ends of adjacent passages such that said testing means and ejecting means are in staggered positions in adjacent passages in relation to the lengths of the passages, so as to more readily accommodate said testing means and ejecting means in adjacent passages.

8. Apparatus for segregating faulty cigarettes, particularly in the hopper of a cigarette packing machine, as said cigarettes pass in a single row in a direction substantially transverse to their lengths through a passage defined by wall means, the positions of said cigarettes as they pass through said passage being unpredictable and not in a well defined stepping motion, said apparatus comprising means for testing individual cigarettes at a predetermined first position along said passage during their movement through the passage to identify faulty cigarettes, means for ejecting faulty cigarettes from the passage at a predetermined second position along said passage downstream from said first position, means for detecting the presence of cigarettes at a predetermined detecting position in said passage as said cigarettes pass therethrough, said predetermined detecting position of said detecting means being between said predetermined first position of said testing means and said predetermined second position of said ejecting means, and control means responsive to the detection of cigarettes by said detecting means for activating at least one of the testing means and the ejecting means.

9. Apparatus for segregating faulty cigarettes, particularly in the hopper of a cigarette packing machine, as said cigarettes pass in a single row in a direction substantially transverse to their lengths through a passage defined by wall means, the positions of said cigarettes as they pass through said passage being unpredictable and not in a well defined stepping motion, said apparatus comprising means for testing individual cigarettes at a predetermined first position along said passage during their movement through the passage to identify faulty cigarettes, means for ejecting faulty cigarettes from the passage at a predetermined second position along said passage downstream from said first position, said ejecting means including means for arresting a moving faulty cigarette in the passage, means for detecting the presence of cigarettes at a predetermined detecting position in said passage as said cigarettes pass therethrough, and control means responsive to the detection of cigarettes by said detecting means for activating at least one of the testing means and the ejecting

10. Apparatus as claimed in claim 9, wherein the arresting means includes pneumatic means for displacing a faulty cigarette sideways in said passage toward said wall means to prevent its further movement through the passage.

11. Apparatus as claimed in claim 10, including an opening in said wall means of said passage for receiving a displaced faulty cigarette.

12. Apparatus as claimed in claim 10, wherein the pneumatic means includes an aperture in said wall means of said passage, a chamber communicating with said aperture, and means for generating suction at said aperture by exhausting high pressure air from said chamber.

13. Apparatus as claimed in claim 9, wherein the arresting means comprises support means extensible into and retractable from the passage.

14. Apparatus as claimed in claim 9, wherein the ejecting means includes means for ejecting a faulty cigarette axially from a position in said passage at which it has been arrested by said arresting means.

15. Apparatus for segregating faulty cigarettes, particularly int he hopper of a cigarette packing machine, as said cigarettes pass in a single row in a direction substantially transverse to their lengths through a passage defined by wall means, the positions of said cigarettes as they pass through said passage being unpredictable and not in a well defined stepping motion, said apparatus comprising means for testing individual cigarettes at a predetermined first position along said passage during their movement through the passage to identify faulty cigarettes, means for ejecting faulty cigarettes from the passage at a predetermined second position along said passage downstream from said first position, said ejecting means including means for arresting a moving faulty cigarette in the passage, means for detecting the presence of cigarettes at a predetermined detecting position in said passage as said cigarettes pass therethrough, and control means responsive to the detection of cigarettes by said detecting means for activating at least one of the testing means and the ejecting means, said testing means comprising an optical detection system having a source for illuminating the ends of successive cigarettes at said first position and a detector for receiving radiation scattered from the ends of successive cigarettes at said first position, said source being arranged such that the level of radiation incident at one axial position of an end of a cigarette at said testing position is higher than the level of radiation incident at a second axial position of an end of a cigarette, said second axial position being a greater distance from said source than said one axial position, and the detector being arranged to be more sensitive to radiation scattered from said second axial position than from said one axial position, thereby compensating for the lower level of incident radiation at said second axial position of an end of a cigarette and assuring consistent detection of similar faulty cigarettes irrespective of the axial positions of their ends.

16. Apparatus for segregating faulty cigarettes, particularly in the hopper of a cigarette packing machine, as said cigarettes pass ian a single row in a direction substantially transverse to their lengths through a plurality of passages defined by wall means, the positions of said cigarettes as they pass through each of said passages being unpredictable and not in a well defined stepping motion, said apparatus comprising means for testing individual cigarettes at a predetermined first position along each of said passages during their movement through said passage to identify faulty cigarettes, means for ejecting faulty cigarettes from said passage at a predetermined second position downstream from said first position in each of said passages, and control means responsive to position of cigarettes in each of said passages for activating at least one of said testing means and said ejecting means in each of said passages, said passages being substantially parallel with adjacent inlet ends, the respective distances of the testing means and ejecting means from the inlet end of each passage being different from the respective distances of the testing means and ejecting means from the inlet ends of adjacent passages such that said testing means and ejecting means are in staggered positions in adjacent passages in relation to the lengths of said passages so as to more readily accommodate said testing means and ejecting means in adjacent passages.

17. Apparatus for segregating faulty cigarettes, particularly in a cigarette packing machine, as said cigarettes pass laterally in a direction substantially transverse to their lengths in a single row through a passage defined by wall means, the positions of said cigarettes as they pass through said passage being unpredictable and not in a well defined stepping motion, said apparatus comprising means for sensing faulty cigarettes in said row at a predetermined first position along said passage, means responsive to the sensing of faulty cigarettes by said sensing means for arresting the movement of only faulty cigarettes at a predetermined arresting position in the passage downstream from said first position, and means for ejecting said faulty cigarettes from the passage after they have been arrested at said predetermined arresting position.

18. Apparatus as claimed in claim 17, wherein the sensing means is arranged to detect faults in cigarettes in a moving stream of cigarettes passing through the passage.

19. Apparatus as claimed in claim 18, wherein the sensing means comprises a source in said wall means for illuminating the ends of successive cigarettes in said passage and optical detection means arranged to respond to radiation scattered from the ends of cigarettes adjacent said source, said detection means being arranged to have greater sensitivity to radiation scattered from cigarette ends in positions relatively more distant from said source than from cigarette ends in positions less distant from said source to compensate for a lower level of illumination of said cigarette ends by said source at said positions relatively more distant from said source and assuring consisting detection of similar faulty cigarettes.

20. Apparatus as claimed in claim 17, wherein the sensing means and arresting means are arranged to operate at a sensing position and said arresting position respectively separated by a distance corresponding to a distance of about a single cigarette diameter in said passage.

21. Apparatus as claimed in claim 20, further comprising a position detector, said sensing means and said arresting means being responsive to said position detector, said position detector being arranged to detect cigarettes located intermediate said sensing and arresting positions for indicating when cigarettes are correctly positioned for sensing by said sensing means and faulty cigarettes are correctly positioned for arresting by said arresting means.

22. Apparatus as claimed in claim 17, including a position detector having means for indicating that a cigarette is in a correct position for monitoring by said sensing means.

23. Apparatus as claimed in claim 22, wherein the position detector includes means for sensing a beam of radiation and means for directing a beam of radiation along a path inclined to the longitudinal axes of said cigarettes towards said sensing means and through at least part of the valley formed between cigarettes which may be abutting in said passage, said beam of radiation being interrupted by each successive cigarette passing through said passage.

24. Apparatus as claimed in claim 17, wherein the arresting means comprises at least one port in said wall means and means for generating suction through said at least one port by exhausting high pressure air in the region of said at least one port.

25. Apparatus as claimed in claim 17, further comprising a position detector including means for indicating that a faulty cigarette has reached a predetermined detection position, said arresting means being operative in response to detection of a faulty cigarette by said position detector to arrest movement of said faulty cigarette at said arresting position and prevent its further movement through the passage.

26. Apparatus for segregating faulty cigarettes, particularly in the hopper of a cigarette packing machine, comprising a pair of spaced sidewalls and a pair of spaced end walls defining a passage along which cigarettes may pass in a single row in a direction substantially transverse to their lengths, the distance between the interior surfaces of said end walls being greater than the length of said cigarettes providing clearance between the ends of said cigarettes and said end walls and variations in the distance between the ends of said cigarettes and said end walls; means for testing individual cigarettes during their movement through said passage to identify faulty cigarettes; means for ejecting faulty cigarettes from said passage; and control means responsive to position of cigarettes in said passage for activating at least one of said testing means and said ejecting means; said testing means including a source in one of said end walls for illuminating the ends of successive cigarettes in said passage and optical detection means arranged to respond to radiation scattered from the end of a cigarette adjacent said source, said detection means being arranged to have greater sensitivity to radiation scattered from cigarette ends in positions relatively more distant from said source than from cigarette ends in positions less distant from said source to compensate for a lower level of illumination of said cigarette ends by said source when said cigarette ends are in said positions relatively more distant from said source and assuring consistent detection of similar faulty cigarettes.

27. Apparatus for segregating faulty cigarettes, particularly in the hopper of a cigarette packing machine, comprising a pair of spaced side walls and a pair of spaced end walls defining a passage along which cigarettes may pass in a single row in a direction substantially transverse to their lengths, the distance between the interior surfaces of said end walls being greater than the length of said cigarettes, providing clearance between the ends of said cigarettes and said end walls and variations in the axial positions of said cigarettes relative to said end walls; means for testing individual cigarettes during their movement through a testing position in said passage to identify faulty cigarettes; means for ejecting faulty cigarettes from said passage; and control means responsive to position of cigarettes in said passage for activating at least one of said testing means and said ejecting means; said testing means including an optical detection system having a source for illuminating the ends of successive cigarettes at said testing position and a detector for receiving radiation scattered from the ends of successive cigarettes at said testing position, said source being arranged such that the level of radiation incident at one axial position of an end of a cigarette at said testing position is higher than the level of radiation incident at a second axial position of an end of a cigarette, said second axial position being a greater distance from said source than said one axial position, and the detector being arranged to be more sensitive to radiation scattered from said second axial position than from said one axial position, thereby compensating for the lower level of incident radiation at said second axial position of an end of a cigarette and assuring consistent detection of similar faulty cigarettes irrespective of the axial positions of their ends.

28. Apparatus for segregating faulty cigarettes, particularly in a cigarette packing machine, comprising a pair of spaced sidewalls and a pair of spaced end walls defining a passage along which cigarettes may pass in a single row in a direction substantially transverse to their lengths, the distance between the interior surfaces of said end walls being greater than the length of said cigarettes, providing clearance between the ends of said cigarettes and said end walls and variations in the distance between the ends of said cigarettes and said end walls; means for sensing faulty cigarettes; means for arresting the movement of a faulty cigarette in said passage; and means for ejecting said faulty cigarette from said passage after it has been arrested; said sensing means including a source in one of said end walls for illuminating the ends of successive cigarettes in said passage and optical detection means arranged to respond to radiation scattered from the ends of cigarettes adjacent said source, said detection means being arranged to have greater sensitivity to radiation scattered from cigarette ends in positions relatively more distant from said source than from cigarette ends in positions less distant from said source to compensate for a lower level of illumination of said cigarette ends by said source at said positions relatively more distant from said source and assuring consistent detection of similar faulty cigarettes.

29. Apparatus for segregating faulty cigarettes, particularly in the hopper of a cigarette packing machine, comprising a pair of spaced sidewalls and a pair of spaced end walls defining a passage along which cigarettes may pass in a single row in a direction substantially transverse to their lengths, the distance between the interior surfaces of said end walls being greater than the length of said cigarettes, providing clearance between the ends of said cigarettes and said end walls and variations in the axial positions of said cigarettes relative to said end walls; means for sensing faulty cigarettes at a sensing position as said cigarettes move through said passage; means for arresting the movement of a faulty cigarette in said passage; and means for ejecting said faulty cigarette from said passage after it has been arrested; said sensing means including an optical detection system having a source for illuminating the ends of successive cigarettes at said sensing position and a detector for receiving radiation scattered from the ends of successive cigarettes at said sensing position, said source being arranged such that the level of radiation incident at one axial position of an end of a cigarette at said testing position is higher than the level of radiation incident at a second axial position of an end of a cigarette, said second axial position being a greater distance from said source than said one position, and the detector being arranged to be more sensitive to radiation scattered from said cigarette ends at said second axial position than from said cigarette ends at said one axial position, thereby compensating for the lower level of incident radiation at said second axial position of an end of a cigarette and assuring consistent detection of similar faulty cigarettes irrespective of the axial positions of their ends.

30. Apparatus for segregating faulty cigarettes, particularly in a cigarette packing machine, comprising wall means defining a passage along which cigarettes are arranged to pass laterally in a direction substantially transverse to their lengths in a single row, means for individually testing successive cigarettes in said row including means for sensing faulty cigarettes at a predetermined sensing position in said passage, an opening in said wall means at one side of the passage downstream of said sensing position, operating means in said wall means opposite said opening and operable across said passage for urging a faulty cigarette sideways in a direction transverse to its axis through into said opening, and means responsive to the sensing of faulty cigarettes by said sensing means for temporarily activating said operating means so that an individual faulty cigarette may be displaced sideways from said passage through said opening and adjacent non-faulty cigarettes in said row may continue their movement through said passage.

31. Apparatus as claimed in claim 30, including a flap for normally closing said opening.

32. Apparatus as claimed in claim 30, wherein the opening comprises a cigarette-retaining trap which is normally filled by a previously rejected faulty cigarette.

33. Apparatus as claimed in claim 30, including means for axially ejecting cigarettes which have passed through said opening.

34. Apparatus as claimed in claim 30, further including support means, responsive to the sensing of faulty cigarettes by said sensing means, temporarily extensible into the passage to prevent movement of a faulty cigarette through the passage beyond said opening.

35. Apparatus as claimed in claim 30 wherein said operating means comprises a retractable pusher extensible across said passage.

36. Apparatus as claimed in claim 30 wherein said operating means comprises means for producing an airflow across said passage.

* * * * *